US006585484B2

(12) United States Patent
Rosenthal et al.

(10) Patent No.: US 6,585,484 B2
(45) Date of Patent: Jul. 1, 2003

(54) PIVOTAL AND REMOVABLE DOOR FOR AN AIR HANDLER

(75) Inventors: David J. Rosenthal, Shamong, NJ (US); Timothy J. Lawlor, Sr., Philadelphia, PA (US); Thomas F. Byrne, Morrisville, PA (US); James T. Vershaw, Tyler, TX (US); Timothy W. Storm, Tyler, TX (US)

(73) Assignee: American Standard Inc., Piscataway, NJ (US)

( * ) Notice: Subject to any disclaimer, the term of this patent is extended or adjusted under 35 U.S.C. 154(b) by 111 days.

(21) Appl. No.: 09/982,664

(22) Filed: Oct. 18, 2001

(65) Prior Publication Data

US 2003/0077169 A1 Apr. 24, 2003

(51) Int. Cl.[7] ..... F04D 29/42
(52) U.S. Cl. ..... 415/201; 415/204; 415/206
(58) Field of Search ..... 415/201, 118, 415/121.2, 204, 206; 220/23.4

(56) References Cited

U.S. PATENT DOCUMENTS 2,302,661 A * 11/1942 Benson ..... 220/836
2,525,868 A 10/1950 Corhanidis
2,710,717 A * 6/1955 Palmer ..... 417/238
4,008,652 A * 2/1977 Baus ..... 415/126
4,035,610 A * 7/1977 Roth ..... 415/204
4,073,597 A * 2/1978 Barnhart et al. ..... 415/201
4,095,646 A 6/1978 Granetzke
4,292,815 A 10/1981 Bolton
4,325,594 A 4/1982 Lang et al.
4,333,206 A 6/1982 Lang et al.
4,337,823 A * 7/1982 DelPercio ..... 165/48.1
4,560,320 A * 12/1985 Baus ..... 415/118
4,776,484 A 10/1988 Hansen
4,787,818 A * 11/1988 Bales et al. ..... 415/201
5,327,956 A 7/1994 Bolton et al.

* cited by examiner

*Primary Examiner*—Edward K. Look
*Assistant Examiner*—Igor Kershteyn
(74) *Attorney, Agent, or Firm*—William J. Beres; William O'Driscoll

(57) ABSTRACT

An air handler enclosure having a pivotal door panel covers an access opening leading to a blower inside the enclosure. The door panel is held in engagement with the enclosure when the panel is fully open or closed. The panel can completely disengage the enclosure if the panel is first pivoted to an intermediate position between the fully open and fully closed positions. However, the weight of the panel itself urges the panel to remain engaged with the enclosure as the panel pivots through the intermediate position, which helps prevent the panel from disengaging the enclosure unintentionally.

20 Claims, 2 Drawing Sheets

PIVOTAL AND REMOVABLE DOOR FOR AN AIR HANDLER

BACKGROUND OF THE INVENTION

1. Field of the Invention

The present invention relates to air conditioning and heating systems, and more specifically to an access door for a furnace, heat pump, air conditioner, or other type of air handler.

2. Description of Related Art

Air conditioning systems typically include an air-handler that provides conditioned air to a comfort zone, such as a room or a designated area within a building. The conditioning of the air may include, but not be limited to heating, cooling, humidifying, dehumidifying, filtering, ventilating, and their various combinations. Air handlers often include a sheet metal enclosure that contains various components, such as a blower, filter, heat exchanger, controls, etc.

When repairing or otherwise servicing an air handler, a hinged door or a removable panel covering an opening in the enclosure can provide access to the various components inside. A hinged door can be easy to use, as it usually takes less dexterity to open and close. A hinged door does not need to be manually realigned to the access opening whenever the door is operated, so a hinged door can be opened and closed quickly. Examples of a hinged door can be found in U. S. Pat. Nos. 4,095,646; 4,292,815; 4,325,594 and 4,333,206.

Sometimes, however, a hinged door may get in the way when doing extensive servicing, such as replacing a blower. In such cases, a removable panel may be preferred, such as the one disclosed in U.S. Pat. 4,776,484. However, a removable panel can be a nuisance to frequently remove and reinstall for minor servicing, such as replacing an air filter.

SUMMARY OF THE INVENTION

To overcome the limitations of current air handler enclosures, it is an object of the invention to provide a door panel that can pivot between open and closed positions and be prevented from disengaging the enclosure when the panel is fully open or closed.

Another object is to provide a pivotal door panel with an intermediate open position where the panel can be completely disengaged from the enclosure.

Another object is to provide a door panel that can pivot open and closed for replacing an air filter, and can be selectively engaged and disengaged from the enclosure for replacing a blower.

A further object is to distribute the weight of a pivotal door panel across a full line of pivoting contact between the panel and the enclosure, thereby reducing contact wear or at least distributing the wear more broadly than if the contact were concentrated at just a few relatively narrow hinges.

A still further object is to use the weight of the panel itself to urge engagement between the panel and the enclosure as the panel pivots through a range of intermediate positions between its fully open and closed positions. This helps prevent the panel from disengaging the enclosure unintentionally.

Yet another object of the invention is to use a relatively short catch in combination with a significantly longer flange underneath the access opening to releasably capture a lip extending from the door panel.

Another object of the invention is to use sheet metal of a substantially uniform thickness to make at least one of the catch, flange, and lip, thereby simplifying the manufacturing process of making the parts.

Another object of the invention is to place the flange along a generally vertical plane to increase the flange's ability to support the weight of the door panel.

Another object of the invention is to provide the door panel with a sheet metal lip having surfaces that are spaced apart and on opposite sides of the sheet metal, wherein one surface keeps the panel and enclosure engaged when the panel is fully open, and the other surface keeps the panel and enclosure engaged when the panel is fully closed, whereby the wear and load is applied alternately to the two surfaces.

Still another object of the invention is to place the two surfaces perpendicular to the direction that the panel would tend to move if the panel were pulled directly away from the enclosure's opening.

These and other objects of the invention are provided by an air handler enclosure having a pivotal door panel that covers an access opening leading to a blower inside the enclosure. The door panel is held in engagement with the enclosure when the panel is fully open or closed. The panel can completely disengage the enclosure if the panel is first pivoted to an intermediate position between the fully open and fully closed positions.

DESCRIPTION OF THE PREFERRED EMBODIMENT

Figure 1:
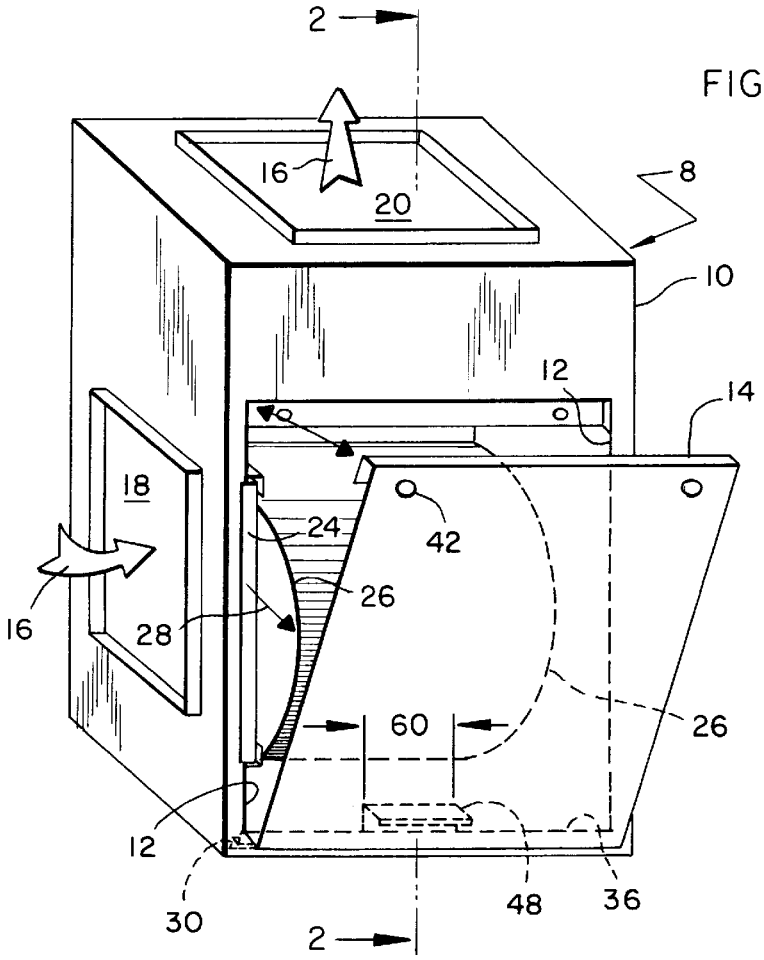
FIG. 1 is a perspective view of an air handler enclosure whose door panel according to one embodiment of the invention is being pivoted open and closed.

An air handler 8, shown in FIGS. 1–5, includes an enclosure 10 with an access opening 12, which is covered by a pivotal door panel 14 that can be readily removed when necessary. Air handler 8 is schematically illustrated to represent any device for moving air 16 between an inlet 18 and an outlet 20 of enclosure 10 for heating, ventilating, filtering, humidifying, de-humidifying, or otherwise conditioning the air of a comfort zone, room, or area within a building. Examples of air handler 8 include, but are not limited to, a blower 26 within an enclosure, a furnace, air conditioner, heat pump, and various combinations thereof. For the illustrated embodiment of the invention, air 16 passing through enclosure 10 is heated or cooled by a heat exchanger 22 and filtered by a serviceable or disposable air filter 24.

Figure 2:
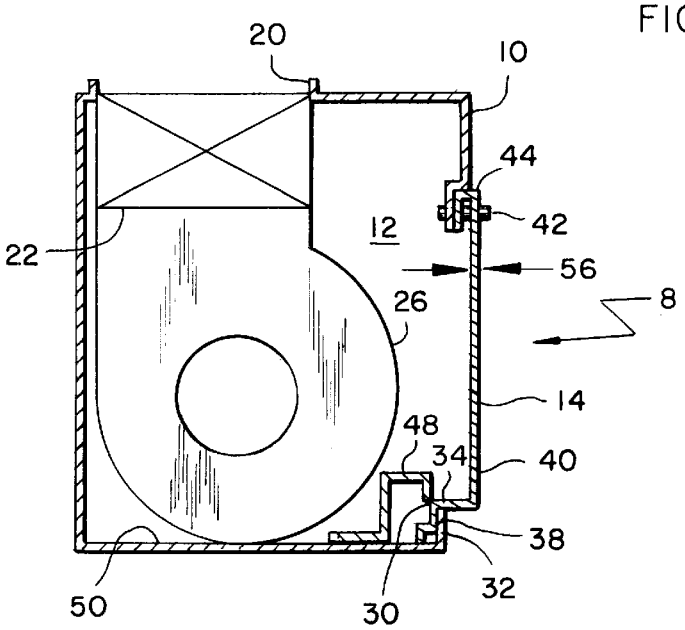
FIG. 2 is a cross-sectional view taken along line 2—2 of FIG. 1, but with the door panel fully closed.
Figure 3:
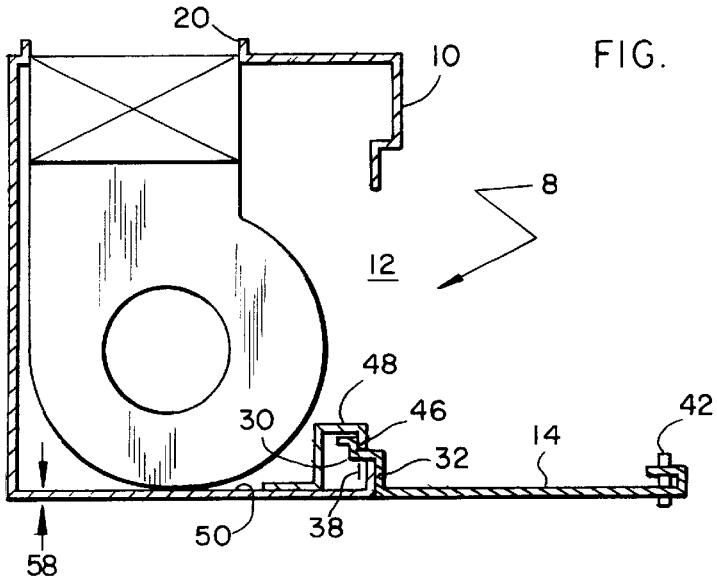
FIG. 3 is similar to FIG. 2, but showing the door panel fully open.

To access filter 24 (e.g., removing filter 24, as indicated by line 28), or to access blower 26 or other components inside enclosure 10, door panel 14 can be pivoted from a fully closed position of FIG. 2 to a fully open position of FIG. 3. In the fully closed position, door panel 14 substantially covers opening 12. And in the fully open position, panel 14 appreciably uncovers opening 12. As panel 14 swings between its open and closed positions, a sheet metal lip 30 extending from panel 14 pivots about a flange 32, which runs along a lower peripheral edge 34 of opening 12. This provides a substantially horizontal line of contact 36 between panel 14 and lower edge 34.

When panel 14 is closed, a first surface 38 of lip 30 engages flange 32 to inhibit a lower edge 40 of panel 14 from separating from enclosure 10. One or more conventional latches 42 help hold an upper edge 44 of panel 14 to enclosure 10. Latches 42 are schematically illustrated to represent any device that helps hold door panel 14 closed.

When panel 14 is fully open, a second surface 46 (spaced apart from surface 38) of lip 30 engages a catch 48, which extends upward from a bottom surface 50 of enclosure 10. Lip 30 engaging catch 48 inhibits panel 14 from completely separating from enclosure 10 when panel 14 is fully open. Thus, when panel 14 is near its fully open or closed positions, lip 30 is captured between catch 48 and flange 32. This helps keep panel 14 and enclosure 10 in an engaged relationship when panel 14 is near its fully open and closed positions.

Figure 4:
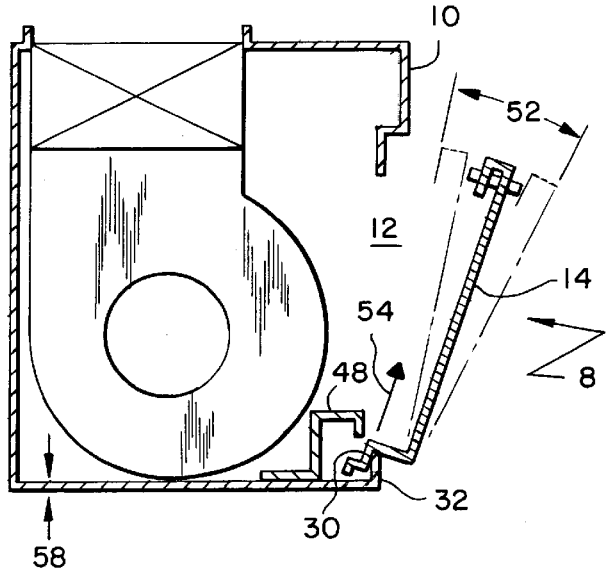
FIG. 4 is similar to FIG. 2, but showing the door panel pivoted within a range of intermediate positions that allows the door panel to be completely removed.
Figure 5:
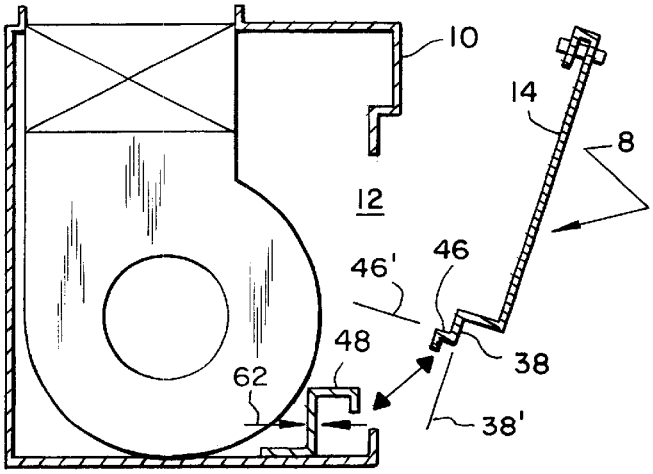
FIG. 5 is similar to FIG. 4, but showing the door panel disengaged from the enclosure.

Keeping door panel 14 engaged with enclosure 10 may be convenient when doing minor servicing, such as changing or cleaning filter 24. However, sometimes panel 14 lying at its fully open position, in front of opening 12, can interfere with work that is more involved, such as replacing blower 26. So, if desired, panel 14 can be pivoted to an intermediate position between the panel's fully open and closed positions, which allows panel 14 to be removed completely. Moving panel 14 anywhere within a range of intermediate positions 52, as shown in FIG. 4, frees lip 30 to be pulled out from between flange 32 and catch 48, as indicated by arrow 54. In some embodiments of the invention, the panel's intermediate or releases positions are about ten degrees away from vertical. Completely removing door panel 14 from enclosure 10 places panel 14 in a disengaged relationship with enclosure 10, as shown in FIG. 5.

When panel 14 is open and closed with no intention of completely removing panel 14, the panel's weight urging panel 14 downward helps keep lip 30 between catch 48 and flange 32 as panel 14 moves through its range of intermediate positions 52.

The specific design of panel 14 can vary; however, in a currently preferred embodiment of the invention, panel 14 and lip 30 are formed of sheet metal having a substantially uniform material thickness 56. In some cases, lip 30 and a major portion of panel 14 comprise a unitary piece. Surfaces 38 and 46 of lip 30 lay along planes 38' and 46', which traverse each other and are preferably perpendicular. Plane 38' is generally parallel to the face of panel 14. Lip 30 pivots on top of flange 32, which lies along a substantially vertical plane. Flange 32 and bottom surface 50 of enclosure 10 can be made of a unitary piece of sheet metal having a substantially uniform material thickness 58. Although lip 30 runs nearly the full width of opening 12, catch 48 may have a much shorter length 60. Catch 48 is also made of sheet metal having a substantially uniform material thickness 62.

Although the invention is described with reference to a preferred embodiment, it should be appreciated by those skilled in the art that other variations are well within the scope of the invention. Therefore, the scope of the invention is to be determined by reference to the claims, which follow.

We claim:

1. An air handler, comprising:

an enclosure defining an inlet, an outlet, and an access opening;

a blower disposed within the enclosure and being adapted to move air from the inlet to the outlet; and a door panel being selectively pivotal to a fully closed position where the door panel substantially covers the access opening, a fully open position where the door panel appreciably uncovers the access opening, and a range of intermediate positions where the door panel is between the fully closed position and the fully open position, the door panel is further moveable between an engaged relationship with the enclosure and a disengaged relationship with the enclosure, wherein the door panel is able to be moved between the engaged relationship and the disengaged relationship when the door panel is within the range of intermediate positions, but is inhibited from being moved between the engaged relationship and the disengaged relationship when the door panel is beyond the range of intermediate positions.

2. The air handler of claim 1, wherein the door panel pivots about a lower edge of the access opening, thereby creating a substantially horizontal line of contact between the door panel and the lower edge.

3. The air handler of claim 1, wherein the weight of the door panel urges the door panel to the engaged relationship as the door panel moves between the fully closed position and the fully open position.

4. The air handler of claim 1, further comprising an air filter disposed within the enclosure, wherein the access opening provides access to the air filter when the door panel is at the fully open position.

5. The air handler of claim 1, wherein the access opening provides access to the blower when the door panel is at the fully open position.

6. The air handler of claim 1, further comprising a catch extending from the enclosure, a flange disposed along a perimeter of the access opening, and a lip extending from the door panel, wherein the lip is captured between the catch and the flange when the door panel is in the engaged relationship.

7. The air handler of claim 6, wherein the lip is longer than the catch.

8. The air handler of claim 6, wherein the catch is made of sheet metal having a substantially uniform thickness.

9. The air handler of claim 6, wherein the lip is made of sheet metal having a substantially uniform thickness.

10. The air handler of claim 6, wherein the flange is made of sheet metal having a substantially uniform thickness.

11. The air handler of claim 6, wherein the flange lies along a substantially vertical plane.

12. The air handler of claim 6, wherein the lip includes a first surface and a second surface that are spaced apart from each other, wherein the catch engaging the first surface inhibits the door panel from disengaging the enclosure when the door panel is in the fully open position and the flange engaging the second surface inhibits the door panel from disengaging the enclosure when the door panel is in the fully closed position.

13. The air handler of claim 12, wherein the second surface is substantially parallel to the door panel.

14. The air handler of claim 12, wherein the first surface lies along a first plane and the second surface lies along a second plane with the first plane traversing the second plane.

15. The air handler of claim 14, wherein the first plane is substantially perpendicular to the second plane.

16. An air handler, comprising:

an enclosure defining an inlet, an outlet, and an access opening;

a blower disposed within the enclosure and being adapted to move air from the inlet to the outlet;

a catch extending from the enclosure;

a flange disposed along a perimeter of the access opening;

a door panel being selectively pivotal to a fully closed position where the door panel substantially covers the access opening, a fully open position where the door panel appreciably uncovers the access opening, and a range of intermediate positions where the door panel is between the fully closed position and the fully open position, the door panel is further moveable between an engaged relationship with the enclosure and a disengaged relationship with the enclosure, wherein the door panel is able to be moved between the engaged relationship and the disengaged relationship when the door panel is within the range of intermediate positions, but is inhibited from being moved between the engaged relationship and the disengaged relationship when the door panel is beyond the range of intermediate positions; and a lip extending from the door panel, wherein:

i. the lip is captured between the catch and the flange when the door panel is in the engaged relationship, ii. the lip includes a first surface and a second surface that are spaced apart from each other, iii. the catch engaging the first surface inhibits the door panel from disengaging the enclosure when the door panel is in the fully open position, iv. the flange engaging the second surface inhibits the door panel from disengaging the enclosure when the door panel is in the fully closed position, and v. the weight of the door panel urges the door panel to the engaged relationship as the door panel moves between the fully closed position and the fully open position.

17. The air handler of claim 16, wherein the door panel pivots about a lower edge of the access opening, thereby creating a substantially horizontal line of contact between the door panel and the lower edge.

18. The air handler of claim 16, wherein the lip is longer than the catch.

19. The air handler of claim 16, wherein the second surface is substantially parallel to the door panel.

20. A method of manipulating a door panel to selectively cover and uncover an access opening of an enclosure, comprising:

pivoting the door panel to a fully closed position where the door panel substantially covers the access opening;

pivoting the door panel to a fully open position where the door panel appreciably uncovers the access opening;

pivoting the door panel through a range of intermediate positions where the door panel is between the fully closed position and the fully open position;

selectively moving the door panel between an engaged relationship with the enclosure and a disengaged relationship with the enclosure; and inhibiting the door panel from moving from the engaged relationship with the enclosure to the disengaged relationship with the enclosure without first pivoting the door panel to within the range of intermediate positions.

* * * * *